US005526652A

United States Patent [19]

Mantovan

[11] Patent Number: 5,526,652

[45] Date of Patent: Jun. 18, 1996

[54] METHOD AND PLANT FOR RAPIDLY COOLING A PRODUCT ROLLED IN A HOT ROLLING MILL

[75] Inventor: Gianfranco Mantovan, Busto Arsizio, Italy

[73] Assignee: Pomini S.p.A., Castellanza, Italy

[21] Appl. No.: 402,309

[22] Filed: Mar. 10, 1995

Related U.S. Application Data

[63] Continuation of Ser. No. 80,475, Jun. 18, 1993, abandoned.

[30] Foreign Application Priority Data

Dec. 1, 1992 [IT] Italy ..... MI92A2756

[51] Int. Cl.[6] ..... F25D 17/02

[52] U.S. Cl. ..... 62/374; 62/63; 62/64; 72/201; 266/134

[58] Field of Search ..... 62/63, 64, 374; 72/201; 266/134

[56] References Cited

U.S. PATENT DOCUMENTS

| | | | |
|---|---|---|---|
| 3,659,428 | 5/1972 | Kunioka et al. | 62/64 |
| 3,722,077 | 3/1972 | Armstrong | 62/64 |
| 4,033,737 | 7/1977 | Kunioka et al. | 62/64 |
| 4,444,556 | 4/1984 | Anderson | 62/64 |
| 4,497,180 | 2/1985 | Graham | 62/64 |

*Primary Examiner*—Ronald C. Capossela
*Attorney, Agent, or Firm*—Hedman, Gibson & Costigan

[57] ABSTRACT

A method for rapidly cooling a product rolled in a rolling mill, for example wire rod fed along a roller conveyor, consists of blasting said product with an air stream in which atomized water is dispersed.

1 Claim, 2 Drawing Sheets

METHOD AND PLANT FOR RAPIDLY COOLING A PRODUCT ROLLED IN A HOT ROLLING MILL

This application is a continuation of U.S. Ser. No. 08/080,475 filed Jun. 18, 1993, now abandoned.

This invention relates to a method and plant particularly suitable for rapidly and uniformly cooling a product rolled in a hot rolling mill, in particular wire rod.

As is well known to the expert of the art, the cooling methods used in hot rolling mills are aimed at drastically reducing production costs while at the same time obtaining a final product of satisfactory quality.

It is also well known that this cost reduction can be increased by increasing the cooling intensity.

The general principles governing cooling intensity increase are based on two types of action, namely:

action of extensive type, such as with regard to the cooling plates, by optimizing the tooth shape, improving the free convection, etc.;

action of intensive type, using various types of cooling such as forced ventilation, water cooling etc.

Whatever the method used, the objectives to be achieved must always be considered. Specifically there are three essential aspects to be considered in cooling methods.

1) Whether to use an adequate cooling system to obtain high cooling rates on the surface of the rolled product, in order to achieve determined technological-mechanical characteristics for a given type of material.

The result of this, for example, is that during rolling, heat treatment can be applied which would otherwise have to be applied successively, and hence achieving a very high cost reduction..

2) Whether to use partial cooling of determined parts of the surface of the rolled product, in order to reduce the temperature differences in the various product section units, these differences being due either to the technological process or deriving from the intrinsic characteristics of the material. This temperature uniformity can contribute, for example, to reducing differences in mechanical characteristics (such as ultimate tensile stress) and physical characteristics (such as linearity) between products.

3) In consideration of the high and ever increasing hourly production rate of modern rolling mills, the need for increasingly efficient cooling systems inserted downstream of the plant has become essential, so that if such systems are not applied directly to the plant there must be large storage areas available to allow conventional cooling in air.

Cooling methods of extensive type (plates, cooling conveyors) have been in use for a considerable time and represent a technique on which considerable research has already been carried out, so that new methods in this sector cannot be expected to bring particular new advantages.

However on the subject of cooling intensity a new field of study has opened up, using three types of cooling:

forced ventilation;

cooling with air jets or with water streams; and cooling with water atomized in air.

These methods have all been used individually, depending on the type of plant.

Analyzing a wire rod line with high rolling speed (≧100 m/s), the intensive cooling regions are located at various points.

1) on the line before entering the high-speed monobloc, to achieve optimum inlet temperature for low-temperature rolling, by cooling with water;

2) in the monobloc between the stands to prevent a too high exit temperature, again by cooling with water;

3) at the monobloc exit before entering the dragger and coiler, to achieve cooling or actual heat treatment using high-pressure water; and 4) downstream of the coiler on a roller conveyor by forced ventilation, which enables the coil to be collected at a temperature of about 200°–300° C. after this cooling.

Historically, the coil turns were initially collected immediately after the coiler in a collection basket, the coil thus formed being then cooled off-line and possible subjected to heat treatment in a furnace.

Use was later made of the system comprising a conveyor, which was initially of chain type and later of roller type, this being known commercially by the trademark STELMOR, with which the coil is conveyed and cooled on rollers, before being collected in a basket and then being transported off-line.

Because of the high exit temperature from the coiler (800°–900° C.) and the high wire feed rate, intensive cooling is necessary in order for the conveyor not to be too long and to ensure an appropriate cooling curve for the rolled product.

This cooling is achieved by forced ventilation using a series of axial or centrifugal fans, which blow air upwards from below the conveyor.

Because of the different thermal masses of the rolled products (diameters varying from 5.5 mm to 16 mm) and the different distribution of the product mass on the conveyor, high air rates are necessary to achieve effective cooling, this being aggravated by that fact that there are certain applications in which cooling has to be slow in the initial part of the conveyor, in order to achieve determined product mechanical characteristics.

This results in high plant cost and also in considerable noise in that the air has to be blown into the environment at high speed (20–40 m/s), and the conveyor region has to be accessible and cannot therefore be adequately closed in.

The general object of the present invention is to advantageously solve the problems of the known art by providing a cooling method and plant by which the production cost of a hot rolled product, in particular wire rod, can be drastically reduced.

This object is attained in accordance with the accompanying claims.

The features of the invention and its advantages compared with the known art will be more apparent from an examination of the ensuing description given by way of example with reference to the accompanying schematic drawings, which show one embodiment of a plant suitable for implementing the method of the invention. In the drawings.

Figure 1:
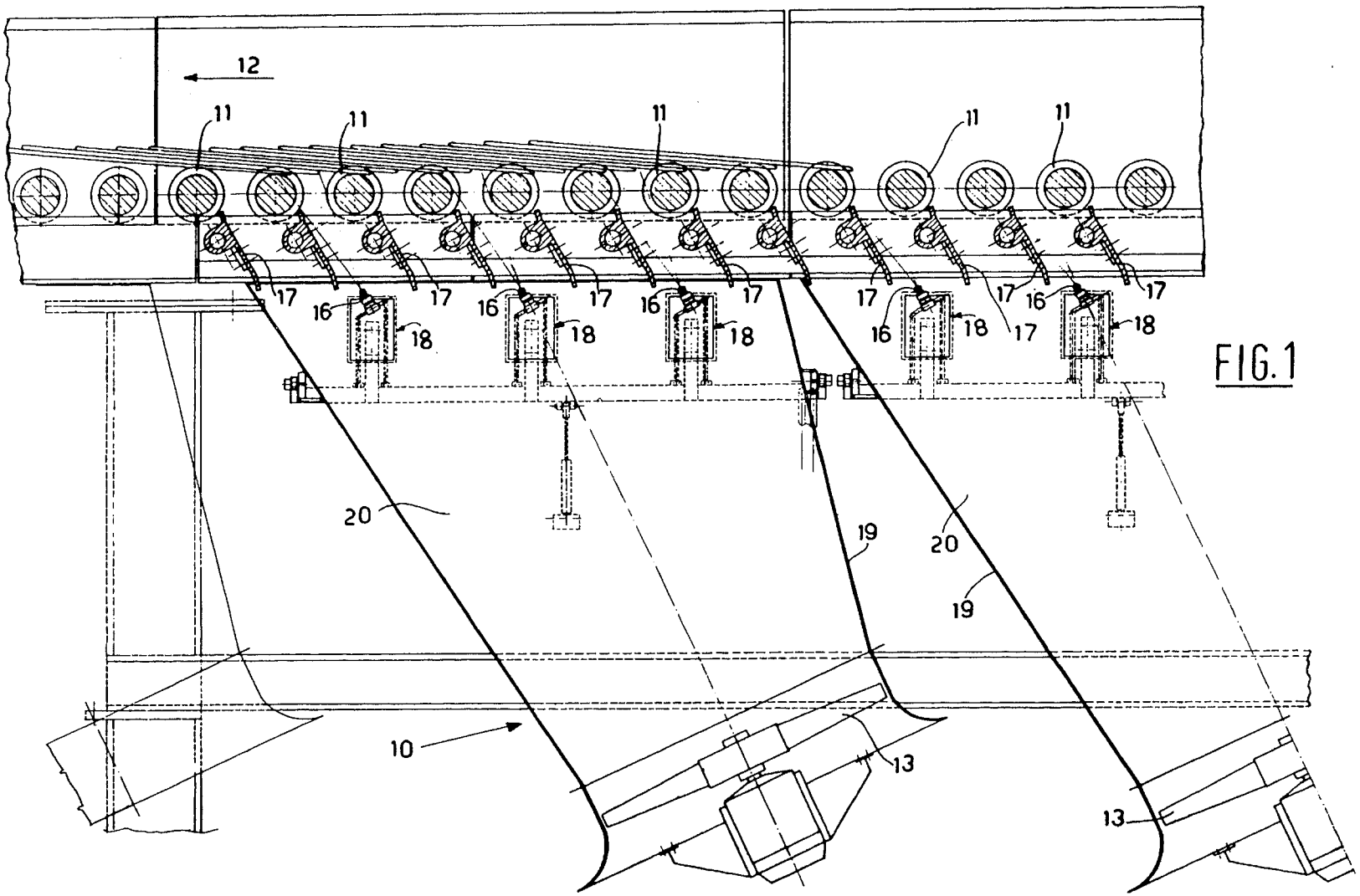
FIG. 1 is a longitudinal section showing said plant.

With reference to the drawings, the plant of the invention is indicated overall by 10 and structurally consists of a roller conveyor 11 on which the hot rolled product, for example wire rod, advances in the direction of the arrow 12.

Below the roller conveyor 11 there are one or more encased fans 13 which blow cooling air, at the desired speed and rate, through said rollers 11 in the direction of the arrows 14, the rate and speed being able to be varied by deflectors 15.

According to the present invention, in said air, blown through a delivery duct 19, there is dispersed atomized cooling water sprayed through a series of lateral nozzles 16.

The atomized water dispersed in the air stream is directed towards the rollers 11 by a series of positionable deflectors 17.

The nozzles 16 can also be positioned as desired, by a linkage indicated generally by 18.

The positioning systems for the nozzles 16 and deflectors 17 are not described in greater detail as they are of any type suitable for the purpose, as available to the designer.

Figure 2:
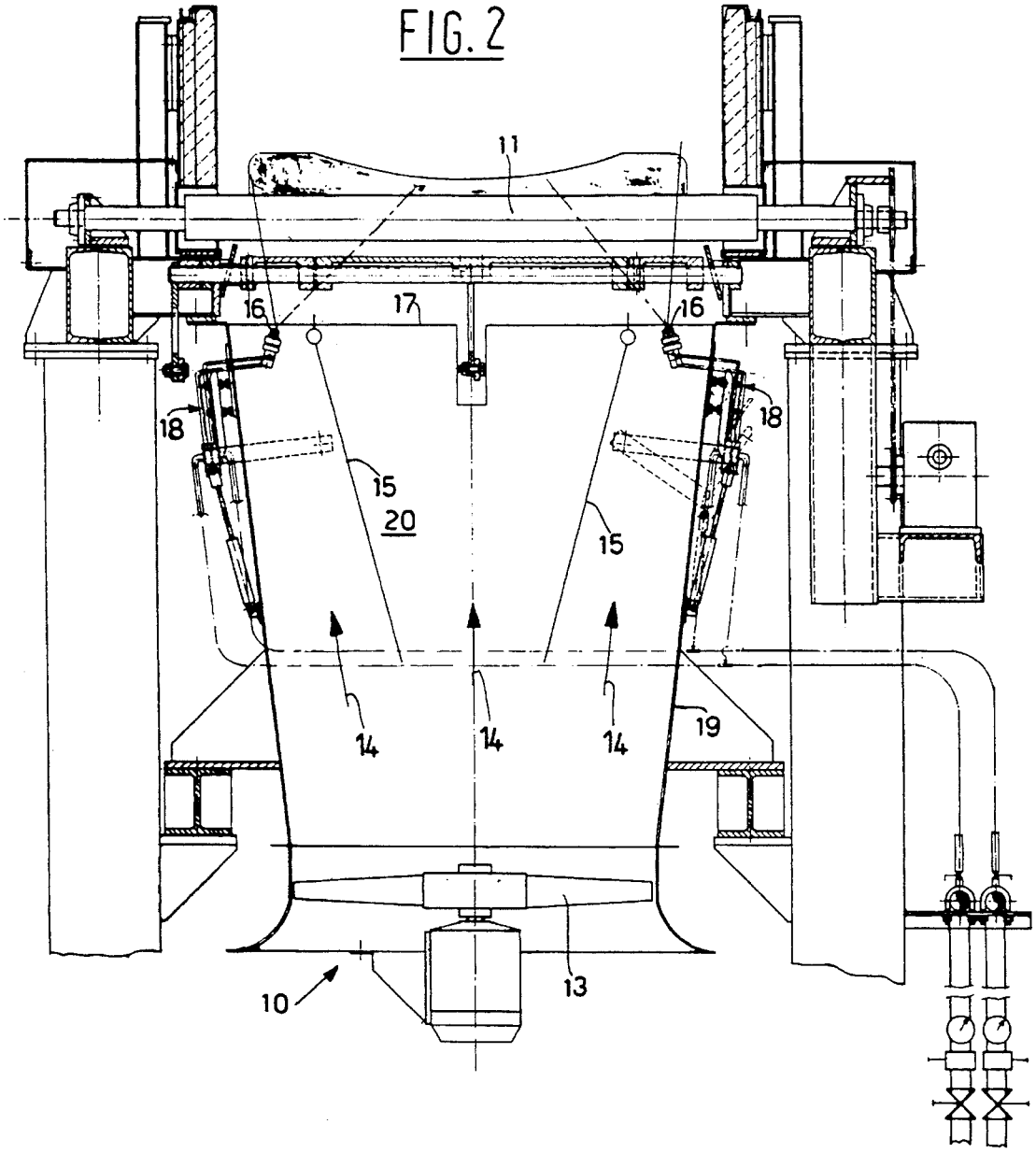
FIG. 2 is a cross-section through the plant of FIG. 1.

As can be clearly seen from FIG. 2 of the drawings, the nozzles 16 are mounted within the duct 19, which by means of the deflectors 15 enables the greatest air flow to be fed into those conveyor regions where the material is most dense.

The nozzles 16 are therefore positioned within the duct region 20 defined by the deflectors 15, in order for the stream of air plus atomized water to be directed where necessary.

The method and plant of the invention achieves the object stated in the introduction to the description.

I claim:

1. A plant for rapidly cooling a product rolled in a rolling mill which is fed along a roller conveyor said plant comprising first means for blasting said roller conveyor with an air stream and second means for dispersing water in said air stream, said first means comprising at least one fan with a delivery duct having in its interior a positionable duct that allows a greater air flow into the region that contains said second means for dispersing water, said second means for dispersing atomized water consist of positionable spray nozzles, said plant also including deflectors which cooperate with said first and second means to direct the atomized water in said air stream towards said roller conveyor.

* * * * *